US005528692A

United States Patent [19]

Hester et al.

[11] Patent Number: 5,528,692

[45] Date of Patent: Jun. 18, 1996

[54] FREQUENCY INVERSION SCRAMBLER WITH INTEGRATED HIGH-PASS FILTER HAVING AUTOZERO TO REMOVE INTERNAL DC OFFSET

[75] Inventors: Richard E. Hester, Phoenix; Scott K. Bader, Gilbert, both of Ariz.

[73] Assignee: Motorola, Inc., Schaumburg, Ill.

[21] Appl. No.: 237,528

[22] Filed: May 3, 1994

[51] Int. Cl.[6] ..... H04K 1/04

[52] U.S. Cl. ..... 380/38; 380/40; 380/19

[58] Field of Search ..... 380/38, 39, 40, 380/19, 9

[56] References Cited

U.S. PATENT DOCUMENTS

| | | | |
|---|---|---|---|
| 3,886,313 | 5/1975 | Branscome et al. | 380/39 |
| 4,160,875 | 7/1979 | Kahn | 380/39 |
| 4,195,202 | 3/1980 | McCalmont | 380/39 |
| 4,652,699 | 3/1987 | Akaiwa | 380/39 |
| 4,790,009 | 12/1988 | Ishigaki et al. | 380/39 |

*Primary Examiner*—David C. Cain
*Attorney, Agent, or Firm*—Robert D. Atkins

[57] ABSTRACT

A frequency inversion scrambler in a cordless telephone utilizes an integrated high-pass filter (14) between a first stage low-pass filter (12) and modulator (16) to reduce the filter order while maintaining low group delay in the audio signal. The first stage low-pass filter and high-pass filter remove high frequency components and any DC offset from the filtered audio signal. The modulator translates the spectrum of the filtered signal to sum and difference frequencies. A second stage low-pass filter (18) removes the upper portion of the spectrum such that the resulting frequency spectrum is inverted with respect to the original audio signal to prevent eavesdropping of transmissions between the handset and base unit of the cordless telephone. Another frequency inversion circuit (30, 32, 34, 36) in the base unit inverts the frequency spectrum again back to its original state for transmission along telephone lines.

20 Claims, 2 Drawing Sheets

FREQUENCY INVERSION SCRAMBLER WITH INTEGRATED HIGH-PASS FILTER HAVING AUTOZERO TO REMOVE INTERNAL DC OFFSET

BACKGROUND OF THE INVENTION

The present invention relates in general to cordless telephone systems and, more particularly, to a frequency inversion scrambler in a cordless telephone.

Cordless telephones are widely used in residential and commercial environments because of their flexibility in allowing the user to venture some distance from the base unit during the conversation. The user speaks into the handset microphone and the voice data is transmitted by RF link to the base unit. The base unit sends the voice data across hard-wire telephone lines to the party on the other end. Voice data from the other party is also received by the base unit and transmitted over the RF link to the handset to complete the two-way conversation.

A common problem with many cordless telephones is the lack of security and privacy in the conversation. It is possible for non-parties to pick-up the same RF communication link, e.g., by way of another cordless telephone nearby or other RF receiver, and hear the private conversation. In the prior art, frequency inversion scramblers have been used to add privacy to the phone conversation by scrambling voice data transmitted over the RF link. Briefly, a frequency inversion scrambler inverts the transmitted frequency spectrum so that non-parties with standard cordless telephones cannot understand the conversation. The base unit for the handset inverts the frequency spectrum again to unscramble the voice data back to its original state for transmission over the telephone lines.

One prior art implementation of the frequency inversion scrambler has a low-pass filter receiving audio signals and a series capacitor between the low-pass filter and a modulator. The series capacitor blocks any DC offset in the audio signal as required for proper modulation. The modulation creates sum and difference frequencies about the modulation frequency. The modulated audio is again low-pass filtered to remove the modulation frequency and higher frequencies before transmission to the base unit. The remaining frequency spectrum is inverted with respect to the original audio signals and thus cannot be understood with standard cordless telephones. The base unit includes a similar low-pass filter and series capacitor into a modulator to re-invert the spectrum back to its original state. Another low-pass filter coupled to the output of the modulator removes the modulation frequency and higher frequencies and provides the base-band voice data for transmission across conventional telephone lines.

The low-pass filters in the frequency inversion scrambler are typically high order, say 10th–14th order, to provide the proper frequency response. The low-pass filter after the modulator needs to be high order for suppression of the modulation frequency and higher frequencies in order to isolate the inverted frequency spectrum. Unfortunately, a higher order filter also tends to increase group delay through the filter which reduces voice quality. It is impractical to move the modulation frequency farther from baseband and use a lower order low-pass filter because low frequency voice data would be lost due to the limited frequency operating band. In addition, the series capacitors are sufficiently large as to require external placement and associated IC pins.

Hence, a need exists for frequency inversion scrambler with lower order filters to reduce group delay while maintaining adequate suppression of the modulation frequency and higher frequencies.

DETAILED DESCRIPTION OF THE PREFERRED EMBODIMENT

Figure 1:
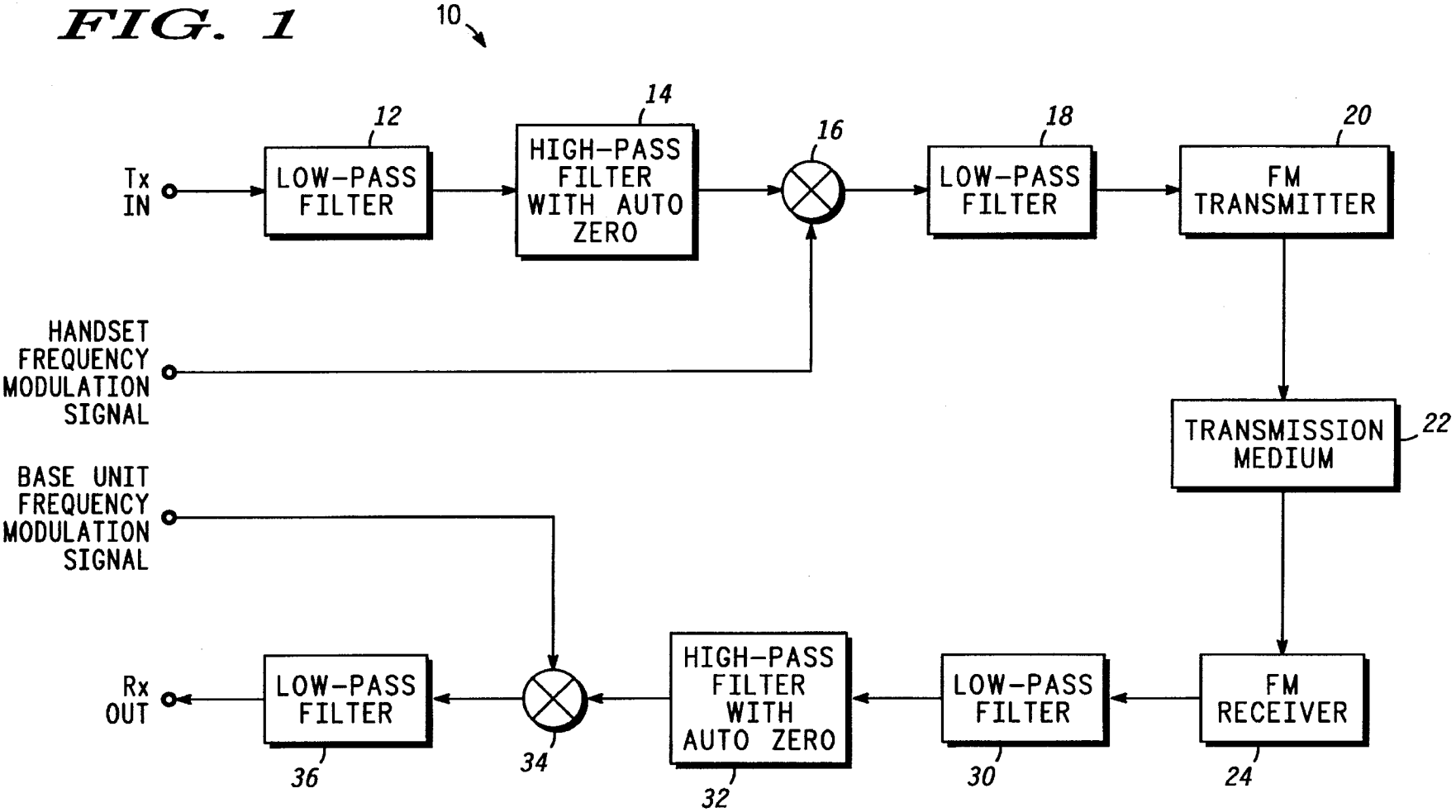
FIG. 1 is a block diagram illustrating a frequency inversion scrambler.

Referring to FIG. 1, a frequency inversion scrambler circuit 10 is shown for use in a cordless telephone. Frequency inversion scrambler 10 comprises low-pass filter 12 receiving an analog input signal TX IN as audio data originating from a microphone in the cordless telephone handset (not shown). The output of low-pass filter 12 is coupled to an input of high-pass filter 14. The output of high-pass filter 14 is coupled to a first input of modulator 16. The second input of modulator 16 receives a frequency modulation signal operating at 3.96 KHz. The output of modulator 16 is coupled to an input of low-pass filter 18. The output of low-pass filter 18 is coupled to an input of FM transmitter 20 that transmits a modulated RF signal, typically 46 to 49 MHz, over transmission medium 22, e.g., airways, to FM receiver 24 in the base unit of the cordless telephone. The de-modulated output of FM receiver 24 is coupled to an input of low-pass filter 30. The output of low-pass filter 30 is coupled to an input of high-pass filter 32. The output of high-pass filter 32 is coupled to a first input of modulator 34. The second input of modulator 34 receives a similar frequency modulation signal operating at 3.96 KHz. The output of modulator 34 is coupled to an input of low-pass filter 36. The output of low-pass filter 36 provides the RX OUT output voice data for transmission over conventional TIP and RING telephone lines (not shown).

The function of frequency inversion scrambler 10 is to scramble the transmitted audio signal so that it can not be understood by non-parties operating other cordless phones, baby monitors, RF scanners or any other FM receivers that operate in the same frequency range as the cordless telephone. In most applications, two frequency inversion scramblers are used in the cordless telephone with one in the handset and one in the base unit. Low-pass filter 12, high-pass filter 14, modulator 16, low-pass filter 18 and FM transmitter 20 are part of transmit side of the cordless telephone handset. FM receiver 24, low-pass filter 30, high-pass filter 32, modulator 34, and low-pass filter 36 are part of receive side of the base unit of the cordless telephone. It is understood that another frequency inversion scrambler is required for the transmit side of the base unit and the receive side of the handset of the cordless telephone, i.e., from the telephone lines through the base unit to the earpiece on the handset.

The operation of frequency inversion scrambler 10 proceeds as follows. Assume the user of the handset speaks into its microphone during a telephone conversation. Voice signals in the audio band, approximately 0.3 to 3.3 KHz, are acoustically coupled to the microphone, amplified by its ancillary circuitry and applied as TX IN to the input of low-pass filter 12. The TX IN signal passes though low-pass filter 12 where the frequencies higher than the audio band are attenuated. Low-pass filter 12 is a fourth-order Elliptic switched-capacitor filter having a corner frequency of 3.5 KHz. The corner frequency determines the high frequency corner of the final frequency response for RX OUT and is chosen to be slightly higher than 3.3 KHz so as to avoid eliminating any of the usable spectrum as a result of processing variations. The corner frequency of low-pass filter 12 must be sufficiently removed from the modulation frequency so the modulation signal is attenuated without having to use a large number of poles that may increase group delay and reduce voice quality. Low-pass filter 12 has 0.4 dB of ripple across its pass-band and 30 dB of stop-band attenuation. The group delay through low-pass filter 12 is 0.12 ms. Low-pass filter 12 may be implemented in differential or single-ended form. The voltage gain ($A_v$) of low-pass filter 12 is two for differential and one for single-ended versions. A clock signal operating at 165.16 KHz controls the switched capacitors (not shown). The details of constructing a fourth-order low-pass Elliptic switched-capacitor filter are determined by the aforedescribed specifications.

As part of the present invention, the low-pass filtered signal at the output of low-pass filter 12 is applied to an integrated high-pass filter 14. In the present embodiment, high-pass filter 14 is an integrated second-order Chebychev switched-capacitor filter having a corner frequency of 165 Hz. The corner frequency of high-pass filter 14 is set below the lowest desired low frequency response in order to reduce group delay within the audio band. High-pass filter 14 has 0.4 dB of ripple across its pass-band, a group delay of 0.03 ms, and $A_v=1$ for both differential and single-ended applications. A clock signal operating at 23.59 KHz controls the switched capacitors. High-pass filter 14 attenuates low frequencies below the audio range and blocks any DC offset in the audio signal. High-pass filter 14 includes an auto-zero feature to reduce any internal DC offset. By using an integrated high-pass filter, two IC pins and one external capacitor commonly used on prior art are eliminated. The details of constructing an integrated second-order high-pass Chebychev switched-capacitor filter are determined by the aforedescribed specifications.

Figure 2:
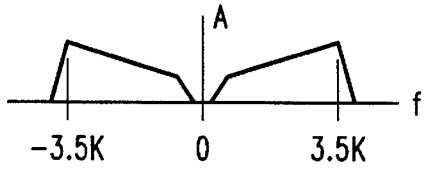
FIGS. 2–7 are waveform plots useful in the explanation of FIG. 1.

FIG. 2 illustrates the frequency spectrum of the audio signal at the output of high-pass filter 14. Frequencies above 3.5 KHz and below 165 Hz are attenuated as described above. The negative frequency spectrum represents the mirror image of the positive frequency audio signal.

Figure 3:
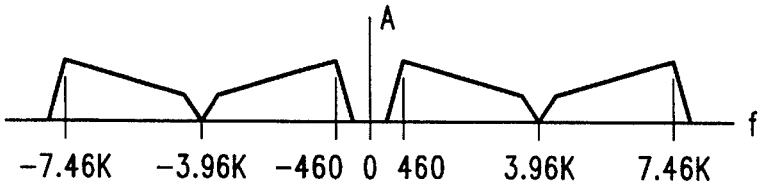

The filtered signal at the output of high-pass filter 14 is applied to double-balanced modulator 16 where it is mixed with a modulation frequency slightly greater than the high frequency corner of the baseband spectrum. In the present example, the modulation frequency is 3.96 KHz. Modulator 18 translates the spectrum of the filtered input signal to frequencies equal to the modulation frequency plus and minus the frequency of the filtered input signal to the modulator. Modulator 18 typically has a voltage gain of $2/\pi$. FIG. 3 illustrates the response of mixing all frequencies in the spectrum defined by low-pass filter 12 and high-pass filter 14. The 7.46 KHz break comes from 3.96 KHz+3.5 KHz while the 460 Hz break results from 3.96 KHz−3.5 KHz.

The output of modulator 16 is applied to low-pass filter 18. The corner frequency of low-pass filter 18 is determined by the desired low frequency corner (260 Hz) of the final response RX OUT in that the low frequency corner is the difference between the modulation frequency and the corner frequency of low-pass filter 18, e.g., 3.96 KHz−3.7 KHz. As a result, the corner frequency of low-pass filter 18 can be set higher than that of low-pass filter 12 in order to optimize low frequency performance without adversely effecting group delay.

In the present embodiment, low-pass filter 18 is a sixth-order Elliptic switched-capacitor filter with a corner frequency of 3.7 KHz. Low-pass filter 18 has 0.6 dB of ripple across its pass-band and 50 dB of stop-band attenuation. The group delay through low-pass filter 18 is 0.175 ms and $A_{v=\pi/}2$ to counter the $2/\pi$ voltage gain from modulator 16. A clock signal operating at 165.16 KHz controls the switched capacitors. The details of constructing a sixth-order low-pass Elliptic switched-capacitor filter are determined by the aforedescribed specifications.

Figure 4:
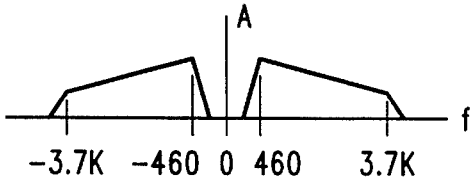

FIG. 4 shows the resulting spectrum at the output of low-pass filter 18. Note that the frequency spectrum is the inverted image of the spectrum at the audio input signal TX IN. The frequency inverted scrambled signal is frequency modulated to RF using conventional techniques and transmitted by FM transmitter 20 in the handset over transmission medium 22 and received by FM receiver 24 in the base unit. Any non-party operating a standard cordless telephone nearby, or other RF receiver, would not be able to understand the frequency inverted audio signal. The conversation is thus maintained as private.

The frequency inverted scrambled signal received at the base unit is first demodulated back to baseband by FM receiver 24. The function of low-pass filter 30, high-pass filter 32, modulator 34, and low-pass filter 36 in the base unit is to de-scramble the audio signal by performing another frequency inversion to return the audio signal to its original state for transmission over the telephone lines.

Low-pass filter 30 is a second-order Elliptic switched-capacitor filter with a corner frequency equal to 3.7 KHz. Low-pass filter 30 attenuates frequencies above 3.7 KHz to eliminate any high frequencies acquired during transmission while minimizing additional group delay. Low-pass filter 30 has 0.6 dB of ripple across its pass-band and 22 dB of stop-band attenuation. The group delay through low-pass filter 30 is 0.04 ms and $A_v=2$ for differential applications and $A_v=1$ for single-ended applications. A clock signal operating at 165.16 KHz controls the switched capacitors. The details of constructing a second-order low-pass Elliptic switched-capacitor filter are determined by the aforedescribed specifications.

As another part of the present invention, the low-pass filtered signal at the output of low-pass filter 30 is applied to an integrated high-pass filter 32. In the present embodiment, high-pass filter 32 is an integrated second-order Chebychev switched-capacitor filter having a corner frequency of 165 Hz. The corner frequency of high-pass filter 32 is set below the lowest desired low frequency response (260 Hz) in order to reduce group delay within the audio band. High-pass filter 32 has 0.4 dB of ripple across its pass-band, a group delay of 0.03 ms, and $A_v=1$. A clock signal operating at 23.59 KHz controls the switched capacitors. High-pass filter 32 attenuates low frequencies below the audio range and blocks any DC offset in the audio signal. High-pass filter 32 includes an auto-zero feature to reduce any internal DC offset as is well known. By using an integrated high-pass filter, two IC pins and one external coupling capacitor commonly used on prior art are eliminated. The details of constructing an integrated second-order high-pass Chebychev switched-capacitor filter are determined by the aforedescribed specifications.

Figure 5:
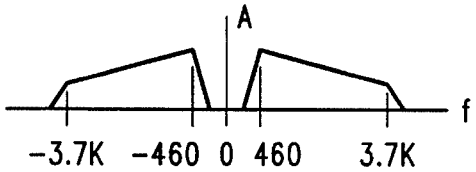

FIG. 5 illustrates the frequency spectrum at the output of low-pass filter 30 similar to that at the output of low-pass filter 18. Frequencies above 3.7 KHz and below 460 Hz are attenuated as described above.

Figure 6:
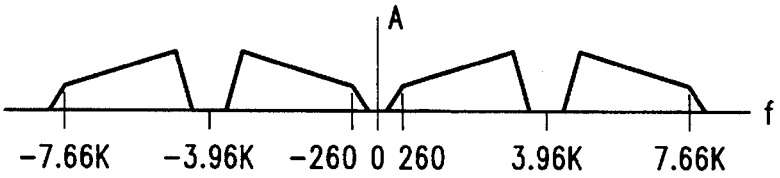

The filtered signal at the output of high-pass filter 32 is applied to double-balanced modulator 34 where it is mixed with a modulation frequency slightly greater than the high frequency corner of the baseband spectrum. In the present example, the modulation frequency is 3.96 KHz. Modulator 18 translates the spectrum of the filtered input signal to frequencies equal to the modulation frequency plus and minus the frequency of the filtered input signal to the modulator. Modulator 34 typically has a voltage gain of $2/\pi$. FIG. 6 illustrates the response of mixing all frequencies in the spectrum defined by low-pass filter 30 and high-pass filter 32. Note the lower corner of the frequency spectrum has been defined by the difference between the modulation frequency and the corner frequency of low-pass filters 18 and 30. The 7.66 KHz break comes from 3.96 KHz+3.7 KHz while the 260 Hz break results from 3.96 KHz–3.7 KHz.

The output of modulator 34 is applied to low-pass filter 36. The corner frequency of low-pass filter 36 determines the high frequency corner of the final frequency response and is chosen to be slightly higher than 3.3 KHz so as to avoid eliminating any of the usable spectrum as a result of processing variations. The corner frequency of low-pass filter 36 must be sufficiently removed from the modulation frequency to adequately suppress the modulation frequency while maintaining voice quality by avoiding unnecessarily long group delays.

In the present embodiment, low-pass filter 36 is an eighth-order Elliptic switched-capacitor filter with a corner frequency of 3.5 KHz to define the upper corner of the final frequency response RX OUT. Low-pass filter 36 eliminates any modulation frequency, baseband frequency, or intermodulation product breakthrough and thus improves the voice quality. Low-pass filter 36 has 0.6 dB of ripple across its pass-band and 50 dB of stop-band attenuation. The group delay through low-pass filter 18 is 0.25 ms and $A_{v=\pi}/2$ to counter the voltage gain of modulator 34. A zero is placed in the frequency response at the modulation frequency 3.96 KHz to further attenuate the modulation frequency. A clock signal operating at 165.16 KHz controls the switched capacitors. The details of constructing an eighth-order low-pass Elliptic switched-capacitor filter are determined by the aforedescribed specifications.

Figure 7:
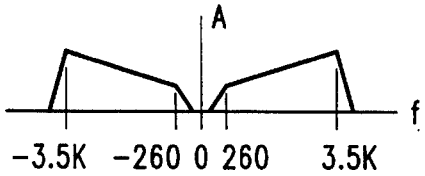

FIG. 7 shows the resulting spectrum at the output of low-pass filter 36. Note the frequency spectrum has been re-inverted back to its original form. The audio signal RX OUT is transmitted out across conventional telephone lines. Another frequency inversion scrambler is required for the transmit side of the base unit and the receive side of the handset for complete two-way private communications.

By now it should be appreciated there has been provided a frequency inversion scrambler with integrated high-pass filter between the first stage low-pass filter and the modulator. The frequency inversion scrambler with high-pass filters improves voice quality by reducing group delay while using lesser order low-pass filters. Moreover, the integrated nature of the high-pass filters reduces die size and eliminates external capacitors and associated IC pins common in the prior art.

While specific embodiments of the present invention have been shown and described, further modifications and improvements will occur to those skilled in the art. It is understood that the invention is not limited to the particular forms shown and it is intended for the appended claims to cover all modifications which do not depart from the spirit and scope of this invention.

What is claimed is:

1. An integrated frequency inversion scrambler circuit, comprising:

a first low-pass filter having an input coupled for receiving an audio input signal;

a first high-pass filter having an input coupled to an output of said first low-pass filter, said first high-pass filter including an autozero to remove internal DC offset in said first high-pass filter;

a first modulator having first and second inputs and an output, said first input being coupled to an output of said first high-pass filter, said second input being coupled for receiving a first modulation signal; and a second low-pass filter having an input coupled to said output of said first modulator and having an output for providing a frequency inverted audio signal.

2. The integrated frequency inversion scrambler circuit of claim 1 further including an FM transmitter having an input coupled to said output of said second low-pass filter and having an output for transmitting an RF frequency inverted audio signal.

3. The integrated frequency inversion scrambler circuit of claim 2 further including an FM receiver having an input coupled for receiving said RF frequency inverted audio signal.

4. The integrated frequency inversion scrambler circuit of claim 3 further including a third low-pass filter having an input coupled to an output of said FM receiver.

5. The integrated frequency inversion scrambler circuit of claim 4 further including a second high-pass filter having an input coupled to an output of said third low-pass filter.

6. The integrated frequency inversion scrambler circuit of claim 5 further including a second modulator having first and second inputs and an output, said first input being coupled to an output of said second high-pass filter, said second input being coupled for receiving a second modulation signal.

7. The integrated frequency inversion scrambler circuit of claim 6 further including a fourth low-pass filter having an input coupled to said output of said second modulator and having an output for providing an output audio signal.

8. A method of frequency inversion scrambling in an integrated circuit, comprising the steps of:

low-pass filtering an audio input signal for providing a first filter signal;

high-pass filtering said first filter signal for providing a second filter signal;

autozeroing said high-pass filtering to remove internal DC offset;

frequency mixing said second filter signal with a first modulation signal for providing a first frequency mixed filter signal; and low-pass filtering said first frequency mixed filter signal for providing a frequency inverted audio signal.

9. The method of claim 8 further including the step of transmitting said frequency inverted audio signal over an RF link as an RF frequency inverted audio signal.

10. The method of claim 9 further including the step of converting said RF frequency inverted audio signal back to a baseband frequency inverted audio signal.

11. The method of claim 10 further including the step of low-pass filtering said baseband frequency inverted audio signal for providing a third filter signal.

12. The method of claim 11 further including the step of high-pass filtering said third filter signal for providing a fourth filter signal.

13. The method of claim 12 further including the step of frequency mixing said fourth filter signal with a second modulation signal for providing a second frequency mixed filter signal.

14. The method of claim 13 further including the step of low-pass filtering said second frequency mixed filter signal for providing an output audio signal.

15. In a cordless telephone handset, a first integrated frequency inversion scrambler circuit, comprising:

a first low-pass filter having an input coupled for receiving an audio input signal;

a first high-pass filter having an input coupled to an output of said first low-pass filter, said first high-pass filter including an autozero to remove internal DC offset in said first high-pass filter;

a first modulator having first and second inputs and an output, said first input being coupled to an output of said first high-pass filter, said second input being coupled for receiving a first modulation signal;

a second low-pass filter having an input coupled to said output of said first modulator and having an output for providing a frequency inverted audio signal; and an FM transmitter having an input coupled to said output of said second low-pass filter and having an output for transmitting an RF frequency inverted audio signal.

16. The cordless telephone of claim 15 further including a base unit having an FM receiver having an input coupled for receiving said RF frequency inverted audio signal.

17. The base unit of the cordless telephone of claim 16 further including a second integrated frequency inversion scrambler circuit.

18. The second integrated frequency inversion scrambler circuit of claim 17 further including:

a third low-pass filter having an input coupled to an output of said FM receiver; and a second high-pass filter having an input coupled to an output of said third low-pass filter.

19. The second integrated frequency inversion scrambler circuit of claim 18 further including a second modulator having first and second inputs and an output, said first input being coupled to an output of said second high-pass filter, said second input being coupled for receiving a second modulation signal.

20. The second integrated frequency inversion scrambler circuit of claim 19 further including a fourth low-pass filter having an input coupled to said output of said second modulator and having an output for providing an output audio signal.

* * * * *